US010847078B2

(12) United States Patent
Aiba

(10) Patent No.: US 10,847,078 B2
(45) **Date of Patent: *Nov. 24, 2020**

(54) IMAGE SIGNAL PROCESSING DEVICE, DITHER PATTERN GENERATING METHOD AND DITHER PATTERN GENERATING PROGRAM

(71) Applicant: JVC KENWOOD CORPORATION, Yokohama-shi, Kanagawa (JP)

(72) Inventor: Hideki Aiba, Yokohama (JP)

(73) Assignee: JVC KENWOOD CORPORATION, Yokohama (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/439,129

(22) Filed: Jun. 12, 2019

(65) Prior Publication Data

US 2019/0385507 A1 Dec. 19, 2019

(30) Foreign Application Priority Data

Jun. 14, 2018 (JP) ..... 2018-113287

(51) Int. Cl.
*G09G 3/20* (2006.01)
*G09G 3/28* (2013.01)

(52) U.S. Cl.
CPC ..... *G09G 3/2055* (2013.01); *G09G 3/2077* (2013.01); *G09G 3/2092* (2013.01); *G09G 3/2803* (2013.01); *G09G 2320/0276* (2013.01)

(58) Field of Classification Search
CPC ... G09G 3/2055; G09G 3/2077; G09G 3/2803
See application file for complete search history.

(56) References Cited

U.S. PATENT DOCUMENTS 6,288,698 B1 * 9/2001 Ishii ..... G09G 3/3622 345/204
6,476,824 B1 * 11/2002 Suzuki ..... G09G 3/2055 345/690
7,692,665 B2 * 4/2010 Daly ..... G09G 3/2055 345/596
2020/0099857 A1 * 3/2020 Nakajima ..... H04N 5/235

FOREIGN PATENT DOCUMENTS

JP 2000-56726 A 2/2000

* cited by examiner

*Primary Examiner* — Antonio A Caschera
(74) *Attorney, Agent, or Firm* — Nath, Goldberg & Meyer; Jerald L. Meyer

(57) ABSTRACT

A storage device stores dither patterns composed of a three-dimensional block consisting of the number H of dots in a horizontal direction×the number V of lines in a vertical direction×the number F in a frame direction. Each value from a minimum value to a maximum value of dither values of n bits is written in each address of the storage device. When each value is written into the storage device, processing of obtaining a spatiotemporal density value indicating a degree of density of an address in which a dither value has already been written in a three-dimensional predetermined area centered on each of the addresses in which a new dither value is writable, and processing of selecting an address having the smallest spatiotemporal density value among the addresses in which a new dither value is writable and writing a dither value are repeated.

4 Claims, 4 Drawing Sheets

IMAGE SIGNAL PROCESSING DEVICE, DITHER PATTERN GENERATING METHOD AND DITHER PATTERN GENERATING PROGRAM

CROSS REFERENCE TO RELATED APPLICATION

This application is based upon and claims the benefit of priority under 35 U.S.C. § 119 from Japanese Patent Application No. 2018-113287 filed on Jun. 14, 2018, the entire contents of which are incorporated herein by reference.

BACKGROUND

The present disclosure relates to an image signal processing device, a dither pattern generating method, and a dither pattern generating program.

An image signal including a first number of gradations by (m+n) bits may be input to a display that is capable of expressing only a second number of gradations by m bits. In this case, the first number of gradations may be expressed in a pseudo manner by applying n-bit multi-gradation processing to an m-bit image signal. One of pseudo multi-gradation processing includes image signal processing called frame rate control (FRC) in which the number of bits is reduced after adding dither data having dither patterns repeating at a plurality of frame periods to an image signal.

SUMMARY

A typical image signal processing device adds different dither patterns of four dots of two horizontal dots and two vertical lines to an image signal at four frame periods, and performs pseudo multi-gradation processing on the image signal. According to the image signal processing device that adds dither data of the dither patterns of four dots at four frame periods, gradation of 2 bits may be expanded in a pseudo manner.

In order to increase the number of bits to be expanded greater than two bits, the size of a block of a dither pattern is set to be greater than four dots and a frame period of adding the dither data of different dither patterns is set to be longer than four frames. However, when dither data in which one block of a dither pattern is large and a frame period is long is added to an image signal, side effects tend to occur. Thus, a dither pattern that is less likely to cause side effects due to the addition of dither data and that is capable of expanding gradation with a high quality is required.

A first aspect of one or more embodiments provides an image signal processing device including: a storage device configured, when the number of dots in a horizontal direction is H, the number of lines in a vertical direction is V, and the number of a frame direction is F, to store dither data having dither patterns composed of a three-dimensional block consisting of the number F in the frame direction, in which the number of dots of H×V is a number exceeding 4, and each block consisting of the number of dots of H×V is set to be one dither pattern, in which a dither value that is one of n bits is set in each dot; an adder configured to add a selected dither pattern for each of the blocks consisting of the number of dots of H×V in a frame of an input image signal having a first number of bits, when the dither patterns of the number F in the frame direction are sequentially selected in a frame period F; and a lower bit reduction unit configured to perform limit processing on an overflow at an output of the adder, and to output an image signal having a second number of bits obtained by reducing the lower n bits of the first number of bits, wherein each value from a minimum value to a maximum value of dither values of n bits is written in each address of the storage device corresponding to each dot of the three-dimensional block consisting of the number of dots of H×V×F, and when each value of the dither values of n bits is written into the storage device, each value of the dither values of n bits is assigned to each dot of the three-dimensional block by repeating processing of obtaining a spatiotemporal density value indicating a degree of density of an address in which a dither value has already been written in a predetermined three-dimensional area centered on each of the addresses in which a new dither value is writable, and processing of selecting an address having the smallest spatiotemporal density value among the addresses in which a new dither value is writable and writing a dither value.

A second aspect of one or more embodiments provides a dither pattern generating method of, when the number of dots in a horizontal direction is H, the number of lines in a vertical direction is V, and the number of a frame direction is F, generating dither patterns composed of a three-dimensional block consisting of the number F in the frame direction, in which the number of dots of H×V is a number exceeding 4, each block consisting of the number of dots of H×V is set to be one dither pattern, in which a dither value that is one of n bits is set in each dot, the dither pattern generating method including: obtaining a spatiotemporal density value indicating a degree of density of an address in which a dither value has already been written in a predetermined three-dimensional area centered on each of the addresses in which a new dither value is writable, from among the addresses in a storage device corresponding to each dot of the three-dimensional block consisting of the number of dots of H×V×F; selecting an address having the smallest spatiotemporal density value among the addresses in which a new dither value is writable, and writing a dither value; and writing each value from a minimum value to a maximum value of dither values of n bits in the addresses of the storage device corresponding to the dots of the three-dimensional block in an arbitrary order to store dither data having dither patterns composed of the three-dimensional block in the storage device, by repeating the obtaining of the spatiotemporal density value and the selecting of the address and the writing of the dither value.

A third aspect of one or more embodiments provides a computer software product that includes a non-transitory storage medium readable by a processor, the non-transitory storage medium having stored thereon a set of instructions for generating dither patterns, when the number of dots in a horizontal direction is H, the number of lines in a vertical direction is V, and the number of a frame direction is F, the dither patterns being composed of a three-dimensional block consisting of the number F in the frame direction, in which the number of dots of H×V is a number exceeding 4, each block consisting of the number of dots of H×V is set to be one dither pattern, in which a dither value that is one of n bits is set in each dot, the instructions including: a first set of instructions which cause the processor to initiate a first processing of obtaining a spatiotemporal density value indicating a degree of density of an address in which a dither value has already been written in a predetermined three-dimensional area centered on each of the addresses in which a new dither value is writable, from among the addresses in a storage device corresponding to each dot of the three-dimensional block consisting of the number of dots of H×V×F; a second set of instructions which cause the processor to initiate a second processing of selecting an address having the smallest spatiotemporal density value among the addresses in which a new dither value is writable, and writing a dither value; and a third set of instructions which cause the processor to initiate a third processing of writing each value from a minimum value to a maximum value of dither values of n bits in the addresses of the storage device corresponding to the dots of the three-dimensional block in an arbitrary order to store dither data having dither patterns composed of the three-dimensional block in the storage device, by repeating the obtaining of the spatiotemporal density value and the selecting of the address and the writing of the dither value.

DETAILED DESCRIPTION

Hereinafter, an image signal processing device, a dither pattern generating method, and a dither pattern generating program according to one or more embodiments will be described with reference to the accompanying drawings.

Figure 1:
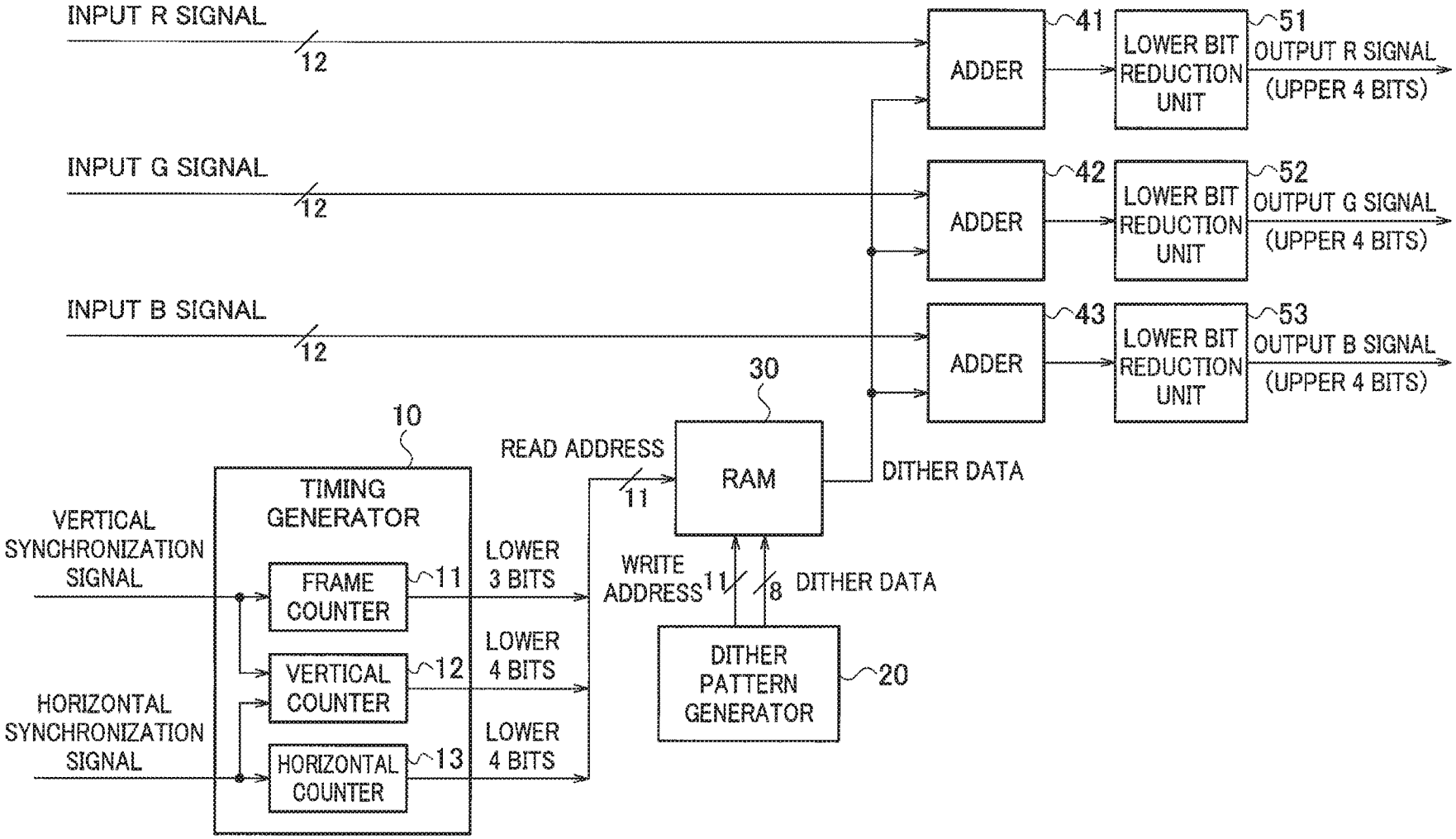
FIG. 1 is a block diagram illustrating an image signal processing device according to one or more embodiments.

In FIG. 1, an image signal processing device according to one or more embodiments includes a timing generator 10, a dither pattern generator 20, a random access memory (RAM) 30, adders 41 through 43, and lower bit reduction units 51 through 53. As an example, input signals input to the image signal processing device are an R signal, a G signal, and a B signal of 12 bits. The image signal processing device according to one or more embodiments outputs an R signal, a G signal, and a B signal of 4 bits by reducing the lower 8 bits after adding a dither pattern described later to the R signal, the G signal, and the B signal.

The timing generator 10 includes a frame counter 11 configured to count frames based on a vertical synchronization signal, a vertical counter configured to count the number of lines in a vertical direction based on the vertical synchronization signal and a horizontal synchronization signal, and a horizontal counter 13 configured to count the number of dots in a horizontal direction based on the horizontal synchronization signal. Note that the vertical counter 12 resets a count value with the vertical synchronization signal and counts up using the horizontal synchronization signal as a trigger.

The timing generator 10 may be realized using hardware such as an ASIC (Application Specific Integrated Circuit), PLD (Programmable Logic Device), or FPGA (Field Programmable Gate Array).

A read address of 11 bits, in which the lower 3 bits of a frame count value generated by the frame counter 11, the lower 4 bits of a vertical count value generated by the vertical counter 12, and the lower 4 bits of a horizontal count value generated by the horizontal counter 13 are combined, is supplied to the RAM 30. The RAM 30 is an example of a storage device.

The dither pattern generator 20 executes a dither pattern generating method according to one or more embodiments to generate a dither pattern. The dither pattern generator 20 may be a central processing unit (CPU) or a computer that executes a dither pattern generating program according to one or more embodiments to generate a dither pattern.

Figure 2:
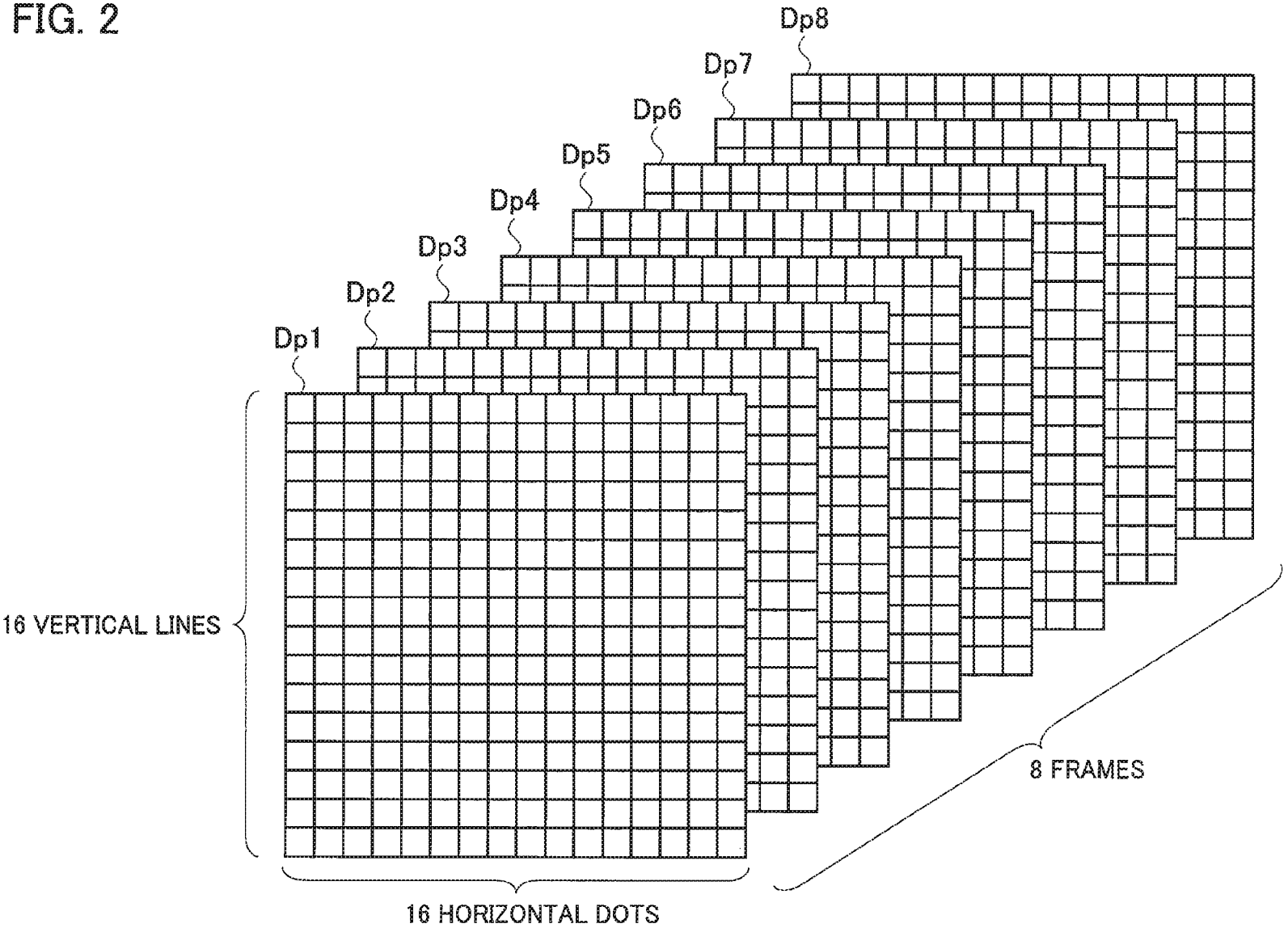
FIG. 2 is a diagram illustrating an example of dither patterns of eight frame periods.

As illustrated in FIG. 2, the dither pattern generator generates dither patterns of eight frame periods consisting of 256 dots of 16 horizontal dots and 16 vertical lines, for example. The dither patterns of eight frame periods will be referred to as dither patterns Dp1 through Dp8. The dither patterns Dp1 through Dp8 have different dither patterns. The dither patterns Dp1 through Dp8 formed of two-dimensional blocks are arranged in the frame direction, and a dither pattern composed of a three-dimensional block is formed by the entire dither patterns Dp1 through Dp8.

Each dot of the dither patterns Dp1 through Dp8 may be specified by 2048 addresses expressible by ii bits. In this regard, the dither pattern generator 20 generates a write address of 11 bits and supplies the write address to the RAM 30. In one or more embodiments, the number of extended bits is 8 to reduce an image signal of 12 bits to 4 bits. Thus, the dither pattern generator 20 generates dither data in which a dither value of 8 bits is assigned to each dot of the dither patterns Dp1 through Dp8. That is, the dither value of each dot is any value from 0 to 255.

The RAM 30 includes 2048 addresses and the 2048 addresses correspond to each dot of the three-dimensional block consisting of the dither patterns Dp1 through Dp8. The dither pattern generator 20 generates the dither value of each dot of the dither patterns Dp1 through Dp8, and writes the respective dither value in an address specified by the write address. Accordingly, the RAM 30 stores the dither data having the dither patterns Dp1 through Dp8 in which the dither value is assigned to each dot.

When the image signal processing device is activated, the dither pattern generator 20 generates the dither data having the dither patterns Dp1 through Dp8, and writes the dither data into the RAM 30. The dither data stored in the RAM 30 is read by the read address of ii bits and supplied to the adders 41 through 43.

In FIG. 1, a RAM is used as a storage device for storing the dither data having the dither patterns Dp1 through Dp8, but a read-only memory (ROM) in which the dither patterns Dp1 through Dp8 generated by the dither pattern generator 20 are written in advance may be used. A type of storage device is not limited. When a ROM is used as a storage device, the dither pattern generator 20 is provided outside the image signal processing device.

The adders 41 through 43 add the dither data of 8 bits to the input R signal, G signal, and B signal of 12 bits. A dither pattern of the dither data added to the R signal, G signal, and B signal is sequentially selected from the dither patterns Dp1 through Dp8 by the read address. The adders 41 through 43 add the dither data of the selected two-dimensional dither pattern for each block by setting 256 dots of 16 horizontal dots and 16 vertical lines in each frame as one block.

The adders 41 through 43 may be realized using hardware such as an ASIC (Application Specific Integrated Circuit), PLD (Programmable Logic Device), or FPGA (Field Programmable Gate Array).

The lower bit reduction units 51 through 53 perform limit processing on overflows of outputs of the adders 41 through 43, respectively, and output the R signal, G signal, and B signal of upper 4 bits by reducing the lower 8 bits. The lower bit reduction units 51 through 53 may be realized using hardware such as an ASIC (Application Specific Integrated Circuit), PLD (Programmable Logic Device), or FPGA (Field Programmable Gate Array).

For example, the lower 8 bits of the R signal, G signal, and B signal of 12 bits may be 128 and the added dither data may be any one of 0 to 127. In this case, since addition results by the adders 41 through 43 are 255 or less, the addition results do not move up to the upper bits. The lower bits of the R signal, G signal, and B signal of 12 bits may be 128 and the added dither data may be any one of 128 to 255. In this case, since the addition results by the adders 41 through 43 are 256 or more, the addition results move up to the upper bits.

When the frequency of the dither values 0 to 255 of the dither data is uniform, a probability of not being moved up to the upper bits and a probability of being moved up to the upper bits are half and half. Accordingly, a probability that the lower bit reduction units 51 through 53 outputs the original upper 4 bits of the input R signal, G signal, and B signal after reducing 128 of the lower 8 bits, and a probability of outputting the upper 4 bits to which +1 is added are half and half. Consequently, 0.5 is expressed on average.

In the above description, the lower 8 bits are 128, but since the lower 8 bits are any one of 0 to 255, the lower 8 bits are as follows considering all of 0 to 255. Dither data having a dither value of 0 to 255 is added to 0 to 255 of the lower 8 bits of the R signal, G signal, and B signal of 12 bits, and the frequency of the lower 8 bits moving to the upper bit becomes one of 0/256 to 255/256. That is, bit expansion of 8 bits is enabled via processing of the adders 41 through 43 and the lower bit reduction units 51 through 53.

The R signal, G signal, and B signal output from the lower bit reduction units 51 through 53 are 4 bits, but the number of gradations of 12 bits is expressed in a pseudo manner according to the bit expansion of 8 bits.

Next, what patterns of the dither patterns Dp1 through Dp8 are required to avoid side effects caused by addition of the dither data and to expand the gradation to high quality will be described.

Conditions required for the dither patterns Dp1 through Dp8 include: Condition 1 in which dither values 0 through 255 are distributed as uniformly as possible within one dither pattern; and Condition 2 in which dither values in a frame direction respectively at positions of the dither patterns Dp1 through Dp8 are distributed as much as possible.

More preferable conditions include, in addition to Conditions 1 and 2: Condition 3 in which a boundary of blocks is not visible within frames of the R signal, G signal, and B signal to which a dither pattern is added and thus there is almost no visual discomfort at the boundary of blocks; and Condition 4 in which a boundary of frame periods of dither patterns is unlikely visible in a frame direction of the R signal, G signal, and B signal to which a three-dimensional block composed of the dither patterns Dp1 through Dp8 are added, and periodicity in the frame direction (specifically, flicker disturbance) is unlikely recognized.

A specific generating method for generating the dither patterns Dp1 through Dp8 so that at least Conditions 1 and 2 are satisfied will be described with reference to FIGS. 3 and 4.

Figure 3:
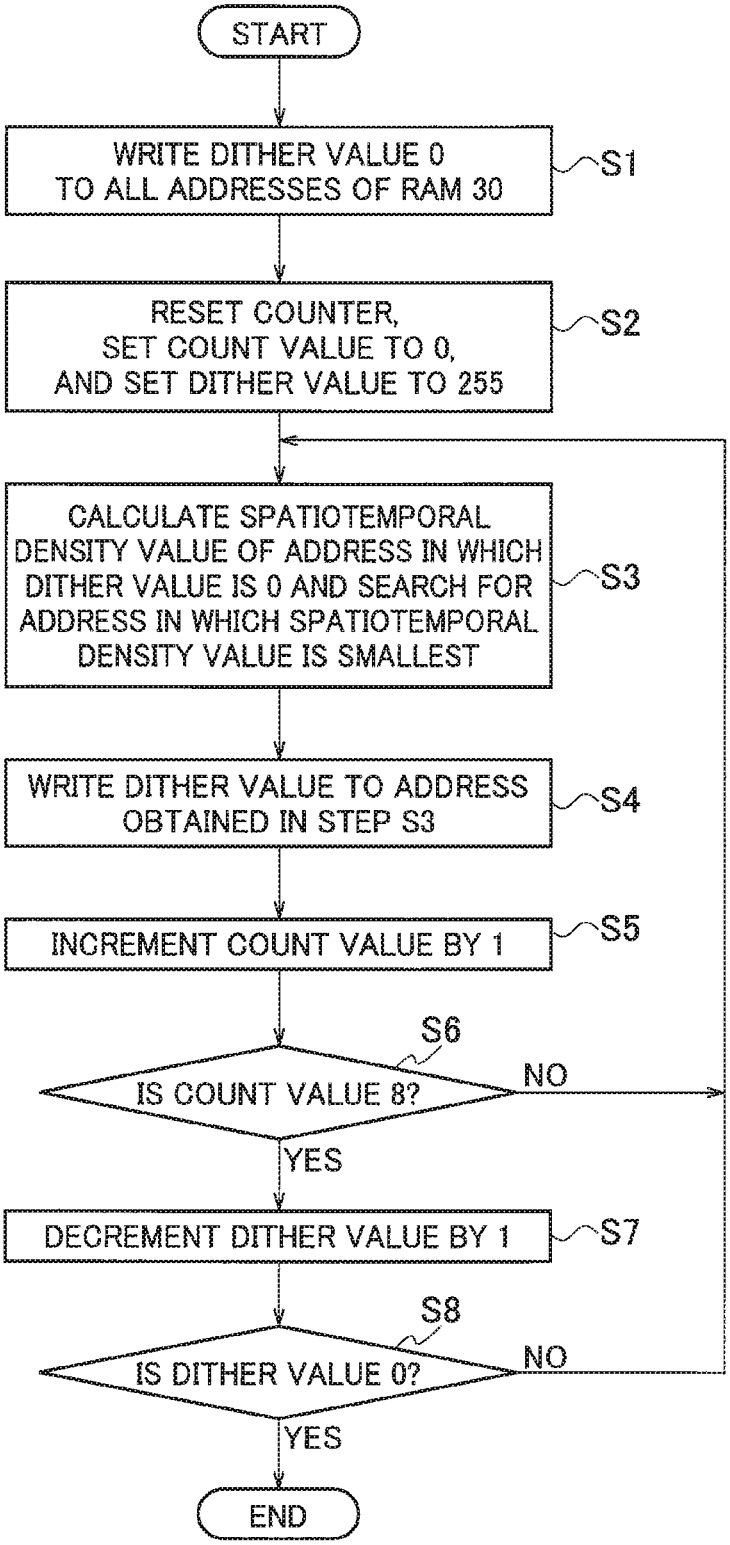
FIG. 3 is a flowchart illustrating processes executed via a dither pattern generating method or dither pattern generating program according to one or more embodiments.

In FIG. 3, the dither pattern generator 20 writes a dither value 0 to all 2048 addresses of the RAM 30 in step S1. The dither pattern generator 20 resets a counter, sets a count value to 0, and sets a dither value to 255 in step S2. The dither pattern generator 20 calculates a spatiotemporal density value of each address in which a dither value is 0 and searches for an address having the smallest spatiotemporal density value in step S3. Step S3 is a first processing for obtaining a spatiotemporal density value.

The spatiotemporal density value is a value indicating a degree of density of an address in which a dither value has already been written in a three-dimensional predetermined area centered on each of the addresses in which a dither value is newly writable, when a dither value is to be newly written in the address of the RAM 30. Details about the spatiotemporal density value will be described later. In the example illustrated in FIG. 3, since the dither value 0 has already been written in all addresses of the RAM 30, the address in which a dither value is newly writable is the address in which the dither value 0 is written.

The dither pattern generator 20 writes the dither value into the address of the RAM 30 obtained via step S3 in step S4. Step S4 is a second processing of selecting the address having the smallest spatiotemporal density value and writing the dither value. In step 4, 255 is first written as the dither value. The dither pattern generator 20 increments a count value by 1 in step S5, and determines whether the count value is 8 in step S6. When the count value is not 8 (NO), the dither pattern generator 20 repeats processes of steps S3 through S6. That is, the dither value 255 is written in the RAM 30 eight times.

When the count value is 8 in step 6 (YES), the dither pattern generator 20 decrements the dither value by 1 in step S7. The dither pattern generator 20 determines whether the dither value is 0 in step S8. When the dither value is not 0 (NO), the dither pattern generator 20 repeats the processes of steps S3 through S8.

That is, into the RAM 30, the dither value 254 is written eight times, then the dither value 253 is written eight times, and as such, processing of wiring the dither value is repeated until the dither value 1 is written eight times. Steps S3 through S8 are a third processing of storing dither data having dither patterns composed of a three-dimensional block in the RAM 30 by repeating the first processing and the second processing.

When the dither value is 0 in step 8 (YES), the dither pattern generator 20 ends the processing.

Through the above processing, each value of dither values 0 to 255 is written eight times to the 2048 addresses of the RAM 30. Since the number of addresses of the RAM 30 is 2048 and the number of extension bits is 8 bits, each value of the dither values 0 to 255 is written eight times (2048/256) so as to be uniformly assigned to the 2048 addresses.

Figure 4:
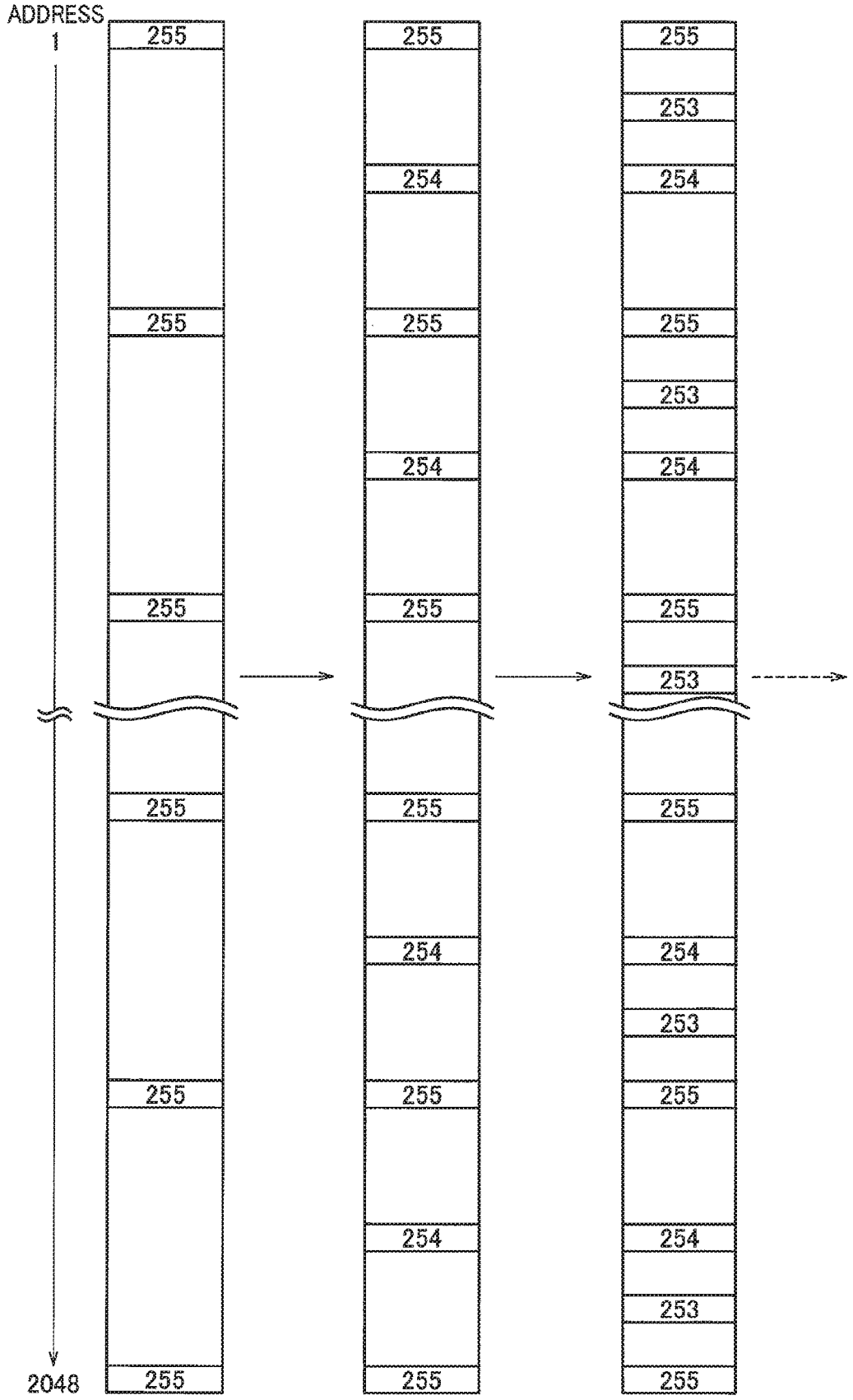
FIG. 4 is a diagram conceptually illustrating processes of sequentially writing dither values to addresses having the smallest spatiotemporal density value in a storage device.

FIG. 4 conceptually illustrates processes of sequentially writing dither values to addresses having the smallest spatiotemporal density value. In FIG. 4, the 2048 addresses of the RAM 30 are illustrated in a single dimension. By selecting the address having the smallest spatiotemporal density value, an address is selected from an area in a three-dimensionally coarse state in which an address in which a dither value has already been written is not present as much as possible, and a new dither value is written.

In FIG. 4, first, eight dither values 255 are written in the RAM 30. Since the eight dither values 255 are written by sequentially selecting the addresses having the smallest spatiotemporal density value among the 2048 addresses, the eight dither values 255 are uniformly distributed within one dither pattern and in the frame direction. Note that, in FIG. 4, the dither value 0 is written in addresses of a blank portion.

Next, the eight dither values 254 are written in the RAM 30. Similarly, the eight dither values 254 are written by sequentially selecting the addresses having the smallest spatiotemporal density value among the remaining 2040 addresses, the eight dither values 254 are almost uniformly distributed within one dither pattern and in the frame direction.

Similarly thereafter, each dither value from the dither value 253 to the dither value 1 is written by sequentially selecting the addresses having the smallest spatiotemporal density value, among addresses in which a dither value is 0 and a new dither value is writable. According to such processing, Conditions 1 and 2 are achieved.

As a comparative example, it is conceivable to randomly select an address to which a dither value is to be written by using a pseudo random number generated by a pseudo random number generator. However, the pseudo random number generator may continuously generate an adjacent address or neighboring address, and thus Conditions 1 and 2 are unable to be achieved.

In the example illustrated in FIG. 3, the dither value 0 is written in all 2048 addresses of the RAM 30 in step S1 and each value from the dither value 255 to the dither value 1 is written in a descending order, but this is only an example of the processing. An order of writing each value from the minimum value to the maximum value of the dither value of 8 bits in the address of the RAM 30 is arbitrary.

A preferable calculating method of a spatiotemporal density value for achieving Conditions 3 and 4 will be described. The address of the RAM 30 is represented by (f, v, h). f indicates a position of a frame of the dither patterns Dp1 through Dp8 and f=0 to 7. v indicates a line position of 16 vertical lines and v=0 to 15. h indicates a dot position of 16 horizontal dots and h=0 to 15.

The dither pattern generator 20 performs filtering processing by a three-dimensional low pass filter (hereinafter, a three-dimensional LPF) with data of an address in which a dither value other than a dither value 0 has already been written being 1 and data of another address being 0. The LPF is a Gaussian filter, for example. Specifically, the dither pattern generator 20 performs a three-dimensional convolution operation on a kernel function of a three-dimensional LPF and data of an address, based on Equation 1 to calculate the spatiotemporal density value D (f, v, h).

$$D(f,v,h)=\Sigma_{i=-4}^{4}\Sigma_{j=-8}^{8}\Sigma_{k=-8}^{8}K(i,j,k)\cdot Q(\mathrm{mod}((f+i+8),8),\ \mathrm{mod}((v+j+16),16),\ \mathrm{mod}((h+k+16),16)) \quad (1)$$

In Equation 1, K (i, j, k) denotes the kernel function of the three-dimensional LPF. i, j, and k are values for respectively determining a range of a frame direction, a range of a vertical direction, and a range of a horizontal direction of a three-dimensional area centered on an address (f, v, h) at which the spatiotemporal density value D(f, v, h) is to be calculated. For example, i=−4 to 4, j=−8 to 8, and k=−8 to 8, and the three-dimensional area may be a predetermined area.

The kernel function K (i, j, k) when a Gaussian filter is used as the three-dimensional LPF is represented by Equation 2. In Equation 2, σ denotes a standard deviation and a specific value may be a design value.

$$K(i,\ j,\ k) = \frac{1}{2\pi a^2}\exp\left(-\frac{i^2+j^2+k^2}{2\sigma^2}\right) \quad (2)$$

Each block of the dither patterns Dp1 through Dp8 is repeatedly used in the frame and the three-dimensional block of the dither patterns Dp1 through Dp8 is repeatedly used in the frame direction. The remainder by b of a is expressed as mod (a, b). Therefore, mod (f+i+8, 8) indicates a first remainder when (f+i+8) is divided by 8 that is a frame period of a dither pattern, mod (v+i+16, 16) indicates a second remainder when (v+i+16) is divided by 16 that is a period (number of lines) in a vertical direction, and mod (h+i+16, 16) indicates a third remainder when (h+i+16) is divided by 16 that is a period (number of dots) in a horizontal direction.

Q (f, v, h) is a function (hereinafter, referred to as a function Q) that return 1 when a dither value other than a dither value 0 is written in the address (f, v, h) and returns 0 when the address (f, v, h) is in an initial value of the dither value 0. An address obtainable by mod (f+i+8, 8), mod (v+j+16, 16), and mod (h+k+16, 16) is referred to as (f', v', h').

Hence, Q (mod (f+i+8, 8), mod (v+j+16, 16), and mod (h+k+16, 16)) in Equation 1 indicate that 1 is returned when a dither value other than the dither value 0 is written in the address (f', v', h') and 0 is returned when the dither value 0 is written therein.

As such, when the spatiotemporal density value D (f, v, h) is calculated in each address, 1 or 0 is assigned to each of addresses obtained via a remainder operation using values of (f+i+8), (v+j+16), and (h+k+16) respectively as a frame period, the number of lines, and the number of dots of dither patterns. Then, the kernel function K (i, j, k) of three-dimensional LPF may be multiplied to 1 or 0 of each address to obtain the spatiotemporal density value D (f, v, h). In step S3 of FIG. 3, an address having the smallest spatiotemporal density value D (f, v, h) is searched for.

When an address having the smallest spatiotemporal density value is searched for and a dither value is written without using the remainder operation, the addresses of the upper, lower, left, and right end portions within the frame are likely to be selected as the address having the smallest spatiotemporal density value. Moreover, in the frame direction, the addresses located in the dither pattern Dp1 or Dp8, which is the end portion in the frame direction, are likely to be selected as the address having the smallest spatiotemporal density value.

In this case, a boundary of blocks in the frame becomes visible and a visual discomfort is likely to occur at the boundary of blocks. In addition, a boundary of a frame period of a three-dimensional block composed of the dither patterns Dp1 through Dp8 becomes visible and thus is easily recognized as flicker disturbance.

By using the remainder operation in the function Q, it is possible to avoid the addresses of the top, bottom, left, and right end portions in the dither pattern from being easily selected as the address having the smallest spatiotemporal density value. In addition, it is possible to avoid the address located in the dither pattern at the end portion in the frame direction from being easily selected as the address having the smallest spatiotemporal density value. Accordingly, Conditions 3 and 4 are achieved.

Meanwhile, i, j, and k that determines a three-dimensional area in which the kernel function K (i, j, k) is multiplied to 1 or 0 obtained by the function Q are generalized to i=−p to p, j=−q to q, and k=−r to r. p, q, and r are predetermined numbers. The number of the frame direction (frame period) of a dither pattern is generalized to F, the number of lines in a vertical direction is generalized to V, and the number of dots in a horizontal direction is generalized to H. F, V, and H are predetermined numbers. Via such generalization, Equation 1 may be expressed by Equation 3.

$$D(f,v,h)=\Sigma_{i=-p}^{p}\Sigma_{j=-q}^{q}\Sigma_{k=-r}^{r}K(i,j,k)\cdot Q(\mathrm{mod}((f+i+F),F),\ \mathrm{mod}((v+j+V),V),\mathrm{mod}((h+k+H),H)) \quad (3)$$

In one or more embodiments described above, the number H of dots in the horizontal direction of the three-dimensional block of the dither pattern is set to 16, the number V of lines in the vertical direction is set to 16, and the number F in the frame direction is set to 8, but are not limited thereto. The number of dots of H×V of one dither pattern is greater than 4. It has been confirmed by verification of the inventor that multi-gradation with less side effects and very high equality is realized not only when H=16 and V=16, but also when H=32 and V=32.

It has been experimentally confirmed that the number F in the frame direction may be 4 to 8 when a frame rate of an image signal is 50 to 60 frames per second (fps) and 8 to 16 when the frame rate is 100 to 120 fps. The dither pattern generator 20 may be configured such as to change the number F in the frame direction based on the frame rate of the image signal. When the image signal processing device illustrated in FIG. 1 is used as a display device capable of changing a frame rate when an image signal is displayed, the dither pattern generator 20 may change the number F in the frame direction based on the frame rate.

When a storage device is configured as a ROM, dither data of the number F in the frame direction corresponding to a plurality of frame rates may be stored in the ROM, or a plurality of ROMs in which dither data of the number F in the frame direction corresponding to each frame rate is stored may be provided.

When H=16, V=16, F=8, and the number n of bits (number of extension bits) of a dither value is 8, the capacity of RAM 30 may be 2048×8 bits. When H=32, V=32, F=8, and n=8, the capacity of RAM 30 may be 8192×8 bits. In either case, the capacity of RAM 30 is relatively small.

When H=32, V=32, F=8, and n=8, each value of the dither values 0 to 255 is written 32 times from 8192/256 in 8192 addresses of the RAM 30. In step S6 of FIG. 3, it is determined whether the count value is 32.

As described above, according to the image signal processing device, the dither pattern generating method, and the dither pattern generating program according to one or more embodiments, a block of a dither pattern has a size exceeding 4 dots, side effects caused by addition of dither data are unlikely to occur, and gradation may be expanded with a high quality.

The present invention is not limited by one or more embodiments described above and various modifications may be made without departing from the scope of the present invention. A first number of bits of an input image signal and a second number of bits of an output image signal are not limited to 12 bits and 4 bits, respectively, and the number of extension bits is also not limited to 8 bits.

The configuration illustrated in FIG. 1 may be constituted by hardware (circuit) or software. The use of hardware and software is arbitrary. The dither pattern generating program is stored in a non-transitory storage medium, loaded in a main memory, and executed by a CPU.

What is claimed is:

1. An image signal processing device comprising:

a storage device configured, when the number of dots in a horizontal direction is H, the number of lines in a vertical direction is V, and the number of a frame direction is F, to store dither data having dither patterns composed of a three-dimensional block consisting of the number F in the frame direction, in which the number of dots of H×V is a number exceeding 4, and each block consisting of the number of dots of H×V is set to be one dither pattern, in which a dither value that is one of n bits is set in each dot, n being an integer in which 2 to the n-th power is less than or equal to H×V×F;

an adder configured to add a selected dither pattern for each of the blocks consisting of the number of dots of H×V in a frame of an input image signal having a first number of bits, when the dither patterns of the number F in the frame direction are sequentially selected in a frame period F; and a lower bit reduction unit configured to perform limit processing on an overflow at an output of the adder, and to output an image signal having a second number of bits obtained by reducing the lower n bits of the first number of bits, wherein each value from a minimum value to a maximum value of dither values of n bits is written in each address of the storage device corresponding to each dot of the three-dimensional block consisting of the number of dots of H×V×F, and when each value of the dither values of n bits is written into the storage device, each value of the dither values of n bits is assigned to each dot of the three-dimensional block by repeating processing of obtaining a spatiotemporal density value indicating a degree of density of an address in which a dither value has already been written in a predetermined three-dimensional area centered on each of the addresses in which a new dither value is writable, and processing of selecting an address having the smallest spatiotemporal density value among the addresses in which a new dither value is writable and writing a dither value.

2. The image signal processing device according to claim 1, wherein in the processing of obtaining the spatiotemporal density value, when the address of the storage device is indicated by (f, v, h), wherein f denotes a position of a frame direction, v denotes a position of a line in a vertical direction, and h denotes a position of a dot in a horizontal direction, D (f, v, h) denotes a spatiotemporal density value in the address (f, v, h), a range i in the frame direction determining the predetermined area is −p to p, a range j in the vertical direction is −q to q, a range k in the horizontal direction is −r to r, where p, q, and r are arbitrary natural numbers, and a kernel function of a three-dimensional low pass filter is K (i, j, k), the spatiotemporal density value D (f, v, h) is obtained according to the following equation:

$$D(f, v, h) = \sum_{i=-p}^{p} \sum_{j=-q}^{q} \sum_{k=-r}^{r} K(i, j, k) \cdot Q(\mathrm{mod}((f+i+F), F), \mathrm{mod}((v+j+V), V), \mathrm{mod}((h+k+H), H))$$

where mod ((f+i+F),F), mod ((v+j+V),V), and mod ((h+k+H),H) in the above equation are remainder operations for respectively obtaining a first remainder by F of (f+i+F), a second remainder by V of (v+j+V), and a third remainder by H of (h+k+H), and where Q(mod((f+i+F),F), mod((v+j+V),V), and mod((h+k+H),H)) are functions that return 1 when addresses determined by the first through third remainders are the addresses in which a dither value has already been written and return 0 when addresses determined by the first through third remainders are the addresses in which a new dither value is writable.

3. A dither pattern generating method of when the number of dots in a horizontal direction is H, the number of lines in a vertical direction is V, and the number of a frame direction is F, generating dither patterns composed of a three-dimensional block consisting of the number F in the frame direction, in which the number of dots of H×V is a number exceeding 4, each block consisting of the number of dots of H×V is set to be one dither pattern, in which a dither value that is one of n bits is set in each dot, n being an integer in which 2 to the n-th power is less than or equal to H×V×F, the dither pattern generating method comprising:

using a processor to obtain a spatiotemporal density value indicating a degree of density of an address in which a dither value has already been written in a predetermined three-dimensional area centered on each of the addresses in which a new dither value is writable, from among the addresses in a storage device corresponding to each dot of the three-dimensional block consisting of the number of dots of H×V×F;

using the processor to select an address having the smallest spatiotemporal density value among the addresses in which a new dither value is writable, and writing a dither value; and using the processor to write each value from a minimum value to a maximum value of dither values of n bits in the addresses of the storage device corresponding to the dots of the three-dimensional block in an arbitrary order to store dither data having dither patterns composed of the three-dimensional block in the storage device, by repeating the obtaining of the spatiotemporal density value and the selecting of the address and the writing of the dither value.

4. A computer software product that includes a non-transitory storage medium readable by a processor, the non-transitory storage medium having stored thereon a set of instructions for generating dither patterns, when the number of dots in a horizontal direction is H, the number of lines in a vertical direction is V, and the number of a frame direction is F, the dither patterns being composed of a three-dimensional block consisting of the number F in the frame direction, in which the number of dots of H×V is a number exceeding 4, each block consisting of the number of dots of H×V is set to be one dither pattern, in which a dither value that is one of n bits is set in each dot, n being an integer in which 2 to the n-th power is less than or equal to H×V×F, the instructions comprising:

a first set of instructions which cause the processor to initiate a first processing of obtaining a spatiotemporal density value indicating a degree of density of an address in which a dither value has already been written in a predetermined three-dimensional area centered on each of the addresses in which a new dither value is writable, from among the addresses in a storage device corresponding to each dot of the three-dimensional block consisting of the number of dots of H×V×F;

a second set of instructions which cause the processor to initiate a second processing of selecting an address having the smallest spatiotemporal density value among the addresses in which a new dither value is writable, and writing a dither value; and a third set of instructions which cause the processor to initiate a third processing of writing each value from a minimum value to a maximum value of dither values of n bits in the addresses of the storage device corresponding to the dots of the three-dimensional block in an arbitrary order to store dither data having dither patterns composed of the three-dimensional block in the storage device, by repeating the obtaining of the spatiotemporal density value and the selecting of the address and the writing of the dither value.

* * * * *